United States Patent [19]

Tomioka et al.

[11] Patent Number: 4,510,789

[45] Date of Patent: Apr. 16, 1985

[54] PRESS BRAKE

[75] Inventors: Kunio Tomioka, Kawasaki; Shigeru Tokai, Komatsu; Tatsuo Tsuchida, Tokyo, all of Japan

[73] Assignee: Kabushiki Kaisha Komatsu Seisakusho, Tokyo, Japan

[21] Appl. No.: 448,604

[22] Filed: Dec. 10, 1982

[30] Foreign Application Priority Data

Dec. 16, 1981 [JP] Japan ..... 56-186219[U]

[51] Int. Cl.[3] ..... B21D 5/02; B21D 43/26

[52] U.S. Cl. ..... 72/442; 72/448; 72/420; 72/405; 72/461; 72/472; 72/384

[58] Field of Search ..... 72/442, 441, 380–382, 72/384, 389, 448, 444, 420, 405, 404, 461, 386–388, 472, 478; 83/549–551; 29/34 R, 565, 564

[56] References Cited

U.S. PATENT DOCUMENTS

| | | | |
|---|---|---|---|
| 401,420 | 4/1889 | Dunaway | 83/552 |
| 629,862 | 8/1899 | Langjahr | 83/549 |
| 1,109,856 | 9/1914 | McCarroll | 72/442 |
| 1,112,544 | 10/1914 | McCarroll | 72/442 |
| 2,153,861 | 4/1939 | Chesley | 72/384 |
| 2,339,032 | 1/1944 | Schlenzig | 72/382 |
| 2,627,890 | 2/1953 | Lloyd et al. | 72/461 |
| 3,138,978 | 6/1964 | Riemenschneider et al. | 72/420 |
| 3,548,628 | 12/1970 | Asari | 72/405 |
| 3,874,205 | 4/1975 | Roch et al. | 72/441 |
| 3,938,416 | 2/1976 | Beauplat | 72/442 |
| 3,942,431 | 3/1976 | Goff | 72/448 |
| 4,220,062 | 9/1980 | Blanz | 83/549 |

FOREIGN PATENT DOCUMENTS

| | | | |
|---|---|---|---|
| 2537865 | 7/1976 | Fed. Rep. of Germany | 72/404 |
| 33855 | 3/1980 | Japan | 72/405 |

*Primary Examiner*—Daniel C. Crane

*Attorney, Agent, or Firm*—Armstrong, Nikaido Marmelstein & Kubovcik

[57] ABSTRACT

A press brake adapted to apply bending on metal blanks in the form of a sheet or plate includes a plurality of die assemblies located on a die holder at intervals of a predetermined distance in the direction perpendicular to the logitudinal direction of a bed of the press brake. The die holder is mounted on the bed movably in the direction perpendicular to the longitudinal direction of the bed. Each of the die assemblies is provided with an upper die and a lower die which are associated with each other and movable vertically towards and away from each other. The press brake further includes a pair of front and inside stoppers located on the front side and the inner side of the press brake body, respectively, so as to be movable freely towards and away from each other and pass through a space between the upper and lower dies.

3 Claims, 12 Drawing Figures

PRESS BRAKE

BACKGROUND OF THE INVENTION

1. Field of the Invention

This invention relates to a press brake adapted to apply bending force on metal blanks in the form of a sheet or plate to bend them.

2. Description of the Prior Art

There has so far been employed a press brake of the kind specified above which comprises a die (or lower die) fitted to a bed, and a punch (or upper die) fitted to a slide or ram and which is arranged to bend a metal blank sheet or plate between the lower die and the punch when the slide is vertically moved.

In such a press brake, however, in the case where it is desired to bend a metal blank sheet or plate in a different shape, it is required to replace the lower die and the punch with ones having the shapes corresponding to the desired configuration. Therefore, the operation becomes troublesome.

Further, when a metal blank sheet or plate is bent several times in a complicated shape, the lower die and the punch are required to be replaced with corresponding ones each time. Therefore, the operation itself becomes troublesome. In particular, in the case where a large metal blank sheet or plate is bent in a complicated configuration, the metal blank sheet or plate tends to tilt on the side of the slide and strike against the operator thus hurting him, and therefore the operation itself is dangerous. Further, when a metal blank sheet or plate is clamped by means of a blank holder, there occurs a difficulty in that the blank holder must be operated or controlled in a complicated manner.

SUMMARY OF THE INVENTION

The present invention has been contemplated in view of the above-mentioned circumstances, and has for its object to provide a press brake adapted to bend metal blanks in the form of sheet or plate into a different shape without having to replace dies such as a lower die and a punch, etc.

According to the present invention, in order to achieve the above-mentioned object, there is provided a press brake characterized by comprising a bed; a vertically movable slide or ram mounted on the body of the press brake oppositely to the bed; a die holder mounted on the bed so as to be reciprocatingly movable back and forth with respect to the press brake body, namely, in the direction perpendicular to a longitudinal direction of the bed; a plurality of die assemblies located on the die holder at intervals of a predetermined distance in the direction perpendicular to a longitudinal direction of the bed, each die assembly being provided with an upper die and a lower die which are associated with each other and held correspondingly while leaving a predetermined space and can be moved vertically towards and away from each other; and a pair of front stopper and inside stopper located on the front side and the inner side of the press brake body, respectively, so as to be movable freely towards and away from each other and to pass through the space between the upper die and the lower die.

BRIEF DESCRIPTION OF THE DRAWINGS

The above and many other advantages, features and additional objects of the present invention will become manifest to those versed in the art upon making reference to the detailed description and accompanying drawings in which preferred structural embodiments incorporating the principles of the present invention are shown by way of illustrative example.

DETAILED DESCRIPTION OF THE INVENTION

The present invention will now be described in detail below by way of example only with reference to the accompanying drawings.

Figure 1:
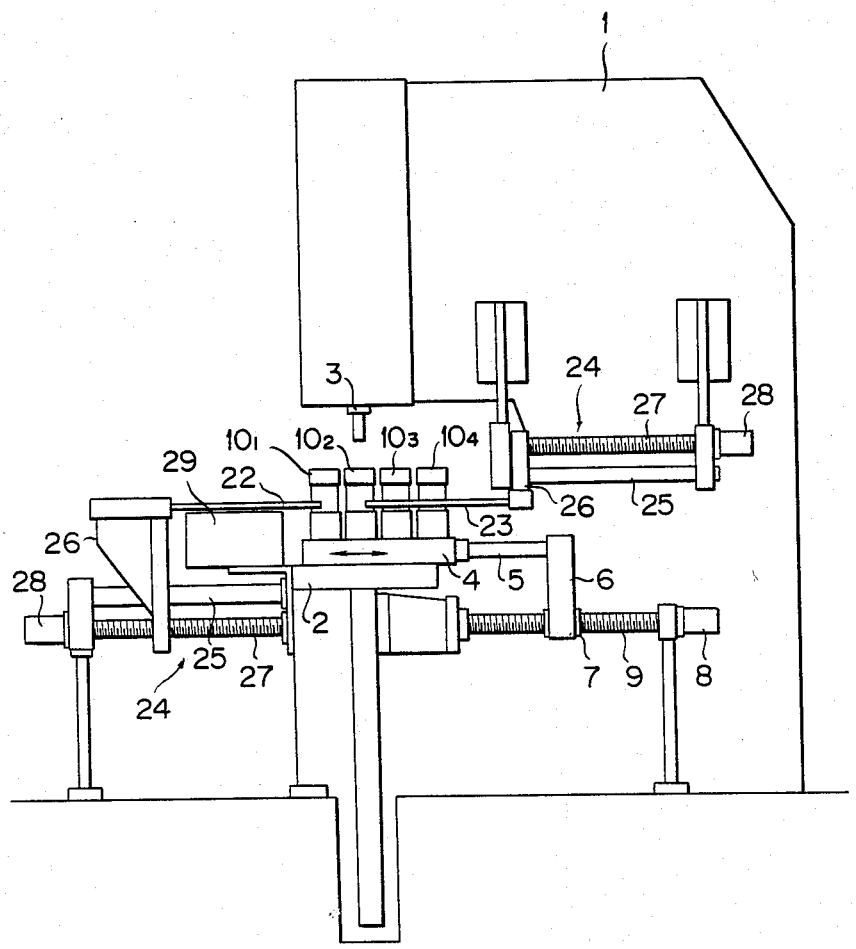
FIG. 1 is an overall elevational side view of one embodiment of a press brake according to the present invention.

FIG. 1 is an overall elevational side view of a press brake according to the present invention. A bed 2 is installed in the lower part of the press brake generally shown by reference numeral 1. A vertically freely movable ram 3 is mounted above and opposite to the bed 2.

A die holder 4 is located on the bed 2 so as to freely reciprocate back and forth with respect to the press brake body, namely, in the directions shown by arrow "X". Connected to a rod 5 which is connected with the die holder 4 is a movable member 6 which rotatably carries a nut member 7. The nut member 7 is threadably engaged with a screw rod 9 which is driven or rotated by a motor 8.

Figure 2:
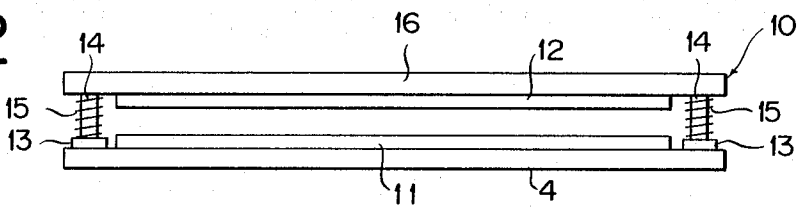
FIG. 2 is an elevational front view of a die assembly.
Figure 3:
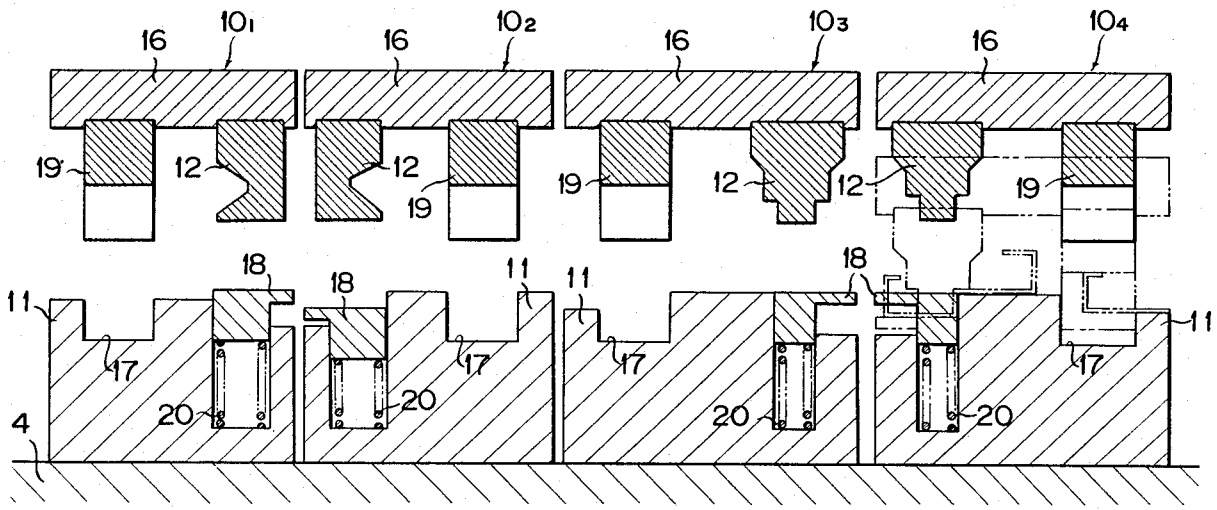
FIG. 3 is an enlarged vertical sectional view of die assemblies.

First, second third and fourth die assemblies $\mathbf{10}_1$, $\mathbf{10}_2$ $\mathbf{10}_3$ and $\mathbf{10}_4$ are located on the die holder 4 at intervals of a predetermined distance in the directions shown by arrow "X". Each of the die assemblies $\mathbf{10}_1$ to $\mathbf{10}_4$ has a lower die 11 and an upper die shoe 16 which holds in a fixed manner an upper die or punch 12, as shown in FIG. 2. The upper die shoe 16 is vertically movably connected through guides 13 and guide posts 14 with the die holder 4 and is biased upwards by the force of springs 15. As illustrated in FIG. 3, the lower die 11 has a recess 17 formed therein and a cushion pad 18 fitted on the upper side thereto, whilst the upper die shoe 16 has fitted thereto in a fixed manner a heel block 19 arranged paralled to the punch 12 and adapted to be fitted into the recess 17. The cushion pad 18 is located opposite to the punch 12 so that it can be freely moved in the vertical direction and is biased upwards by the force of a spring 20. The cushion pad 18 and the punches 12 have different configurations as shown in FIG. 3, respectively.

A front stopper 22 is located in front of the aforementioned press brake body, while an inside stopper 23 is located opposite to the front stopper 22, and therefore these stoppers are positioned between the lower die 11 and the punch 12. The stoppers 22 and 23 are so arranged that they can be reciprocated freely by a means of moving mechanism 24, respectively, in the direction shown by arrow "X". Each of the moving mechanism 24 for the stoppers 22 and 23 comprises a movable member 26 which is movable along a guide rod 25, and a screw rod 27 adapted to be engaged with the movable member 26 and driven or rotated by an electric motor 28. Each movable member 26 is connected with the stoppers 22 and 23, respectively.

Figure 4:
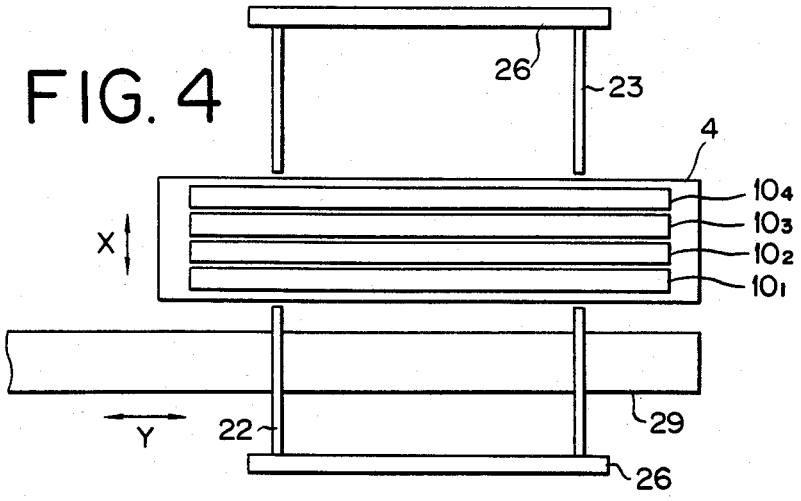
FIG. 4 is a schematic plan view of a principal part of the press brake according to the present invention.
Figure 5A:
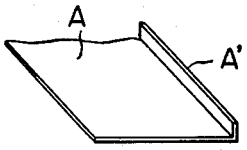
FIGS. 5A, 5B, 5C, 5D and 5E are explanatory views illustrating an example of bending processes applied on a metal blank sheet or plate.
Figure 5B:
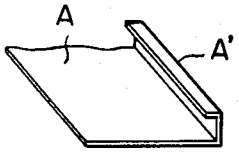
Figure 5C:
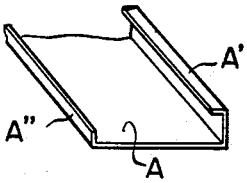
Figure 5D:
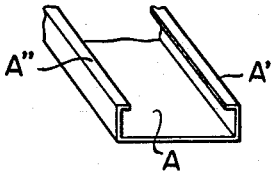
Figure 5E:
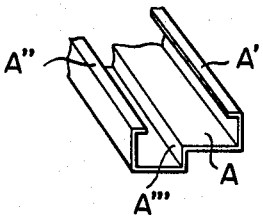

Located under the above-mentioned front stopper 22 is a metal blank sheet or plate conveyor means 29 such as a conveyor or the like which is adapted to convey a metal blank sheet or plate in the longitudinal direction of the bed 2, namely, in the direction shown by arrow "Y" in FIG. 4. The metal blank sheets or plates are supplied, in turn, from one side of the press brake body and conveyed to a predetermined position.

Thus, a metal blank sheet or plate A is conveyed by the conveyor means 29 to a predetermined position opposite to the die assemblies $\mathbf{10}_1$ to $\mathbf{10}_4$. The metal blank sheet or plate A is fed into the metal die assemblies $\mathbf{10}_1$ to $\mathbf{10}_4$ by moving the front sttoper 22 inwardly, and it is clamped by both the front stopper 22 and the inside stopper 23 by moving the latter forwardly.

In operation, the die holder 4 is moved and positioned so that any desired one of the die assembly $\mathbf{10}_1$ to $\mathbf{10}_4$ may be located opposite to the ram 3. After that, the front and inside stoppers 22 and 23 are shifted to locate the metal blank sheet or plate A at a predetermined bending position between the cushion pad 18 of a desired lower die 11 and a punch 12 located opposite to the latter. Subsequently, the ram 3 is lowered to press the metal blank sheet or plate A.

Thus, the metal blank sheet or plate A can be bent in a desired configuration by selectively using any one of the die assemblies $\mathbf{10}_1$ to $\mathbf{10}_4$ without having to replace them.

Figure 6:
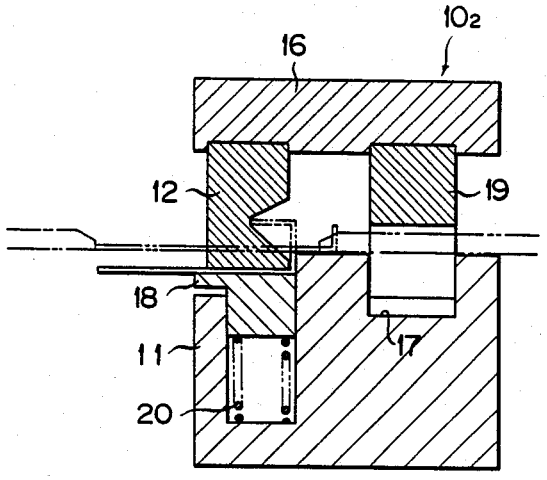
FIGS. 6, 7 and 8 are enlarged vertical sectional views for explaining the bending processes by means of the die assemblies.
Figure 7:
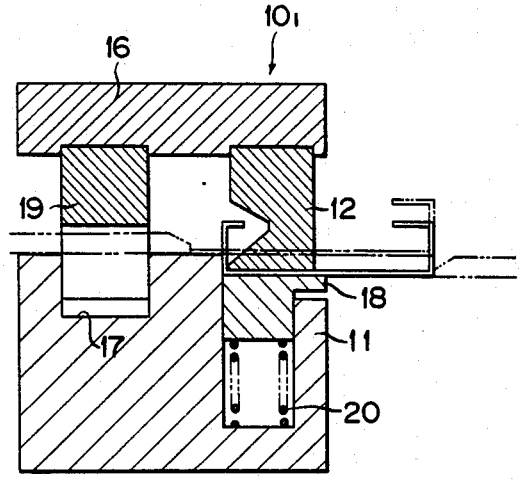
Figure 8:
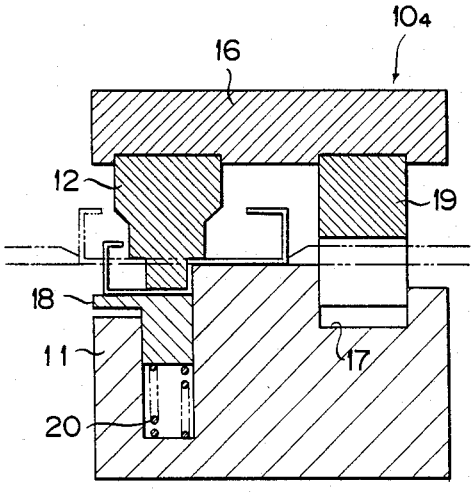

Further, when it is desired to press or bend the metal blank sheet or plate A as shown in FIGS. 5A to 5E, one end A′ of the metal blank sheet or plate A is first bent by means of the second die assembly $\mathbf{10}_2$ as shown in FIG. 6. Thereafter, the metal blank sheet or plate A is moved slightly backwards to bend the end thereof in a channel shape. In the next place, the metal blank sheet or plate A is bent twice at its other end A″ by means of the first die assembly $\mathbf{10}_1$ in the channel shape as shown in FIG. 7. Subsequently, the metal blank sheet or plate A is bent at the intermediate part A‴ thereof by means of the fourth die assembly $\mathbf{10}_4$ in the shape as shown in FIG. 8.

Thus, the metal blank sheet or plate can be bent easily, quickly and safely in any desired configuration by means of the press brake according to the present invention.

It is to be understood that the foregoing description is merely illustrative of a preferred embodiment of the invention, and that the scope of the invention is not to be limited thereto, but is to be determined by the scope of the appended claim.

What is claimed is:

1. A press brake adapted to apply bending on metal blanks in the form of a sheet or plate comprising:

a bed extending along a longitudinal direction in a horizontal plane;

a vertically movable ram mounted on a body of the press brake oppositely to the bed;

a die holder mounted on the bed so as to be reciprocatingly movable in the direction perpendicular to a longitudinal direction of the bed;

a plurality of die assemblies separate from said die holder and located on said die holder at intervals of a predetermined distance in the direction perpendicular to the longitudinal direction of the bed, each die assembly being provided with an upper die and a lower die which are associated with each other and held correspondingly while leaving a predetermined space and can be moved vertically towards and away from each other, each said die assembly further comprising a die shoe for supporting said upper die with each shoe being separate from the other shoes and wherein each upper die and associated lower die is provided with opposed working faces within said space; and a front stopper and an inside stopper located on opposite sides of the press brake body, and means for moving said front stopper and inside stopper freely towards and away from each other so as to pass through the spaces between the upper dies and the lower dies, said front stopper and inside stopper being movable across the entire working faces of at least one die assembly within said space.

2. The press brake as set forth in claim 1, wherein said upper die comprising an upper die shoe vertically movably connected through guides and guide posts with said die holder, a punch fixedly secured to the lower side of said upper die shoe, and a heel block fixedly secured also to the lower side of said upper die shoe and arranged parallel to said punch.

3. The press brake as set forth in claim 1, wherein said lower die is provided with a recess formed in the upper surface thereof at a position opposite to a heel block formed in the upper die so as to receive the same thereinto, a cushion pad fitted on the upper side to said lower die and located opposite to said punch, and a spring means for biasing said cushion pad upwards so as to move freely said die block in the vertical direction.

* * * * *